US006575097B1

(12) United States Patent
Nodarse et al.

(10) Patent No.: US 6,575,097 B1
(45) Date of Patent: Jun. 10, 2003

(54) LARGE CALIBER CASE TELESCOPED AMMUNITION

(75) Inventors: Robert Nodarse, Stillwater, NJ (US); Leon R. Manole, Great Meadows, NJ (US); Samuel LaFontaine, Paterson, NJ (US); Ernest L. Logsdon, Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/064,591

(22) Filed: Jul. 29, 2002

(51) Int. Cl.[7] ..... F42B 5/02
(52) U.S. Cl. ..... 102/434
(58) Field of Search ..... 102/434, 433

(56) References Cited

U.S. PATENT DOCUMENTS 4,691,638 A * 9/1987 Meyer et al. ..... 102/434
5,042,388 A * 8/1991 Warren et al. ..... 102/434
5,063,852 A * 11/1991 Warren ..... 102/434
5,067,407 A * 11/1991 Martwick ..... 102/434
5,069,137 A * 12/1991 Martwick ..... 102/434
5,147,978 A * 9/1992 Northrup et al. ..... 102/434
5,157,224 A * 10/1992 Desevaux et al. ..... 102/434
5,388,522 A * 2/1995 Martwick et al. ..... 102/434
5,467,716 A * 11/1995 Boual ..... 102/434
5,557,059 A * 9/1996 Warren et al. ..... 102/434
6,158,348 A * 12/2000 Campoli ..... 102/443
6,182,574 B1 * 2/2001 Giannoni ..... 102/516
6,237,497 B1 * 5/2001 Altenau et al. ..... 102/524
6,305,293 B1 * 10/2001 Fry et al. ..... 102/517

* cited by examiner

*Primary Examiner*—Charles T. Jordon
*Assistant Examiner*—Jordon M Lofdahl
(74) *Attorney, Agent, or Firm*—Michael C. Sachs; John F. Moran

(57) ABSTRACT

13A case telescoped ammunition cartridge includes: a cylindrical cartridge case, a projectile disposed within the casing and a sleeve surrounding a portion of the forward end of the projectile. An obturator is disposed between the aft end of the sleeve and part of forward end of the projectile. A cup-shaped aft end seal is affixed to the case at the aft end thereof so as to be relatively movable with respect thereto during firing of the cartridge. The seal includes an external lateral surface adapted to engage an inner wall surface of a gun chamber. A cup-shaped forward end seal is affixed to the case at the forward end thereof so as to be relatively movable with respect thereto during firing of the cartridge. The forward end seal includes an external lateral surface adapted to engage the inner wall surface of the gun chamber and an external end surface adapted to abut a forward end surface of the gun chamber. The forward end seal is secured to a corresponding portion of the forward end of the sleeve within the case.

2 Claims, 2 Drawing Sheets

LARGE CALIBER CASE TELESCOPED AMMUNITION

FEDERAL RESEARCH STATEMENT

The inventions described herein may be manufactured, used and licensed by or for the U.S. Government for U.S. Government purposes.

BACKGROUND OF INVENTION

1. Field of the Invention

The present invention relates to case telescoped ammunition and, more particularly, large caliber case telescoped ammunition, i.e., of a caliber on the order of 105 mm or larger.

2. Background of the Invention

Case telescoped ammunition, or CTA, is a term used for ammunition wherein the projectile is telescoped back into, or contained completely within, the cartridge case. Such ammunition differs from most conventional ammunition wherein the front end of the projectile protrudes from the front of the cartridge case.

At present, case telescoped ammunition has been developed for 40 mm, 75 mm and 90 mm cartridges, which are generally considered to be small and medium caliber cartridges. This ammunition is designed for maximum pressures of approximately 70 Kpsi.

As far as the inventors are aware, there is currently no 105 mm or larger caliber case telescoped ammunition. One problem with developing such large caliber ammunition is that the pressures are larger (up to 90 Kpsi) and this presents special challenges as described in more detail below. There is a specific demand for 105 mm CTA for use in a rapid autoloader swing chamber gun being developed for the U.S. Future Combat System (FCS) Multi-Role Armament Ammunition System (MRAAS).

SUMMARY OF INVENTION

According to the invention, case telescoped ammunition is provided which is of larger caliber than the corresponding ammunition of the prior art and which is suitable for use in, inter alia, the swing chamber gun mentioned above.

In accordance with the invention, there is provided a case telescoped ammunition cartridge comprising:

- a cartridge case having a forward end and an aft end;
- a projectile disposed within the casing and having a forward end and an aft end;
- a sleeve surrounding at least a portion of the forward end of the projectile and having a forward end and an aft end;
- an obturator disposed between the aft end of the sleeve and a part of said portion of the forward end of the projectile;
- an aft end seal affixed to said case at the aft end of case so as to be relatively movable with respect thereto during firing of the cartridge and including an external lateral surface adapted to engage an inner wall surface of a gun chamber; and
- a forward end seal affixed to said case at the forward end of the case so as to be relatively movable with respect thereto during firing of the cartridge and including an external lateral surface adapted to engage the inner wall surface of the gun chamber and an external end surface adapted to abut a forward end surface of the gun chamber, said forward seal being secured to the forward end of said sleeve so as to support said sleeve within the case.

Preferably, the forward and aft end seals are cup-shaped and include a base portion and a substantially cylindrical wall portion projecting outwardly from the base portion. Advantageously, the wall portions of the end seals include engagement surfaces for engaging corresponding engagement surfaces of the cartridge case. The engagement surfaces of the end seals and the cartridge case preferably include V-shaped grooves therein for enabling longitudinal dislocation between the end seals and the corresponding ends of the cartridge case while preventing full disengagement of said engagement surfaces and corresponding separation of said end seals from said case. The engagement surfaces of said end seals are advantageously located on interior parts of the projecting wall portions thereof. Preferably, the projecting wall portion of the forward end seal further includes an interior surface secured to said sleeve and located forwardly of the engagement surface of the forward end seal. Advantageously, this interior surface includes screw threading and a corresponding portion of the sleeve secured to the forward end seal includes complementary screw threading.

In one preferred embodiment, the external lateral surfaces of the end seals include a non-metal coating thereon. The coating advantageously comprises a plastic or rubber coating.

In an alternative preferred embodiment, the end seals include at least one ring member extending around the external lateral surfaces thereof. Advantageously, the ring member comprises a rubber or plastic member.

Further features and advantages of the present invention will be set forth in, or apparent from, the detailed description of preferred embodiments thereof which follows.

DETAILED DESCRIPTION

Figure 1:
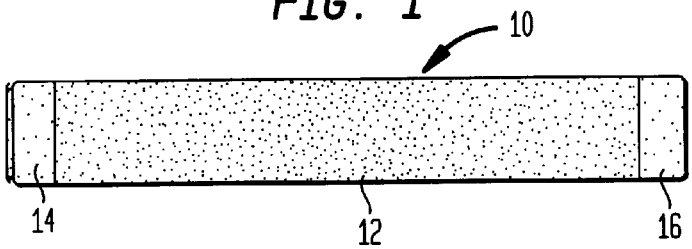
FIG. 1 is a side elevational view of a CTA cartridge in accordance with a preferred embodiment of the invention.
Figure 2:
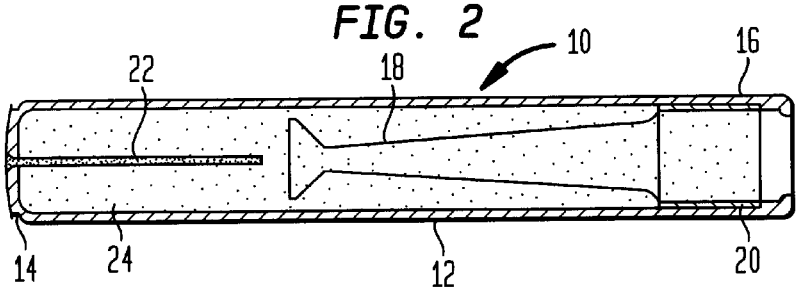
FIG. 2 is a cross-sectional view, drawn to a somewhat enlarged scale, of the cartridge of FIG. 1 showing the interior components thereof.

Referring to FIGS. 1 and 2, there is shown a case telescoped ammunition cartridge, which is generally denoted 10 and which includes, as shown in FIG. 1, a cartridge case 12 , an aft seal 14 and a forward seal 16. As shown in FIG. 2, the cartridge also includes a projectile 18, a projectile sleeve 20, a primer 22, and a propellant bed 24 for containing a propellant (not shown). These are the basic elements of the CTA cartridge 10 and as will become apparent, key elements function together to make the cartridge work.

Cartridge case 12 is a simple cylinder as is evident from FIGS. 1 and 2. In a preferred embodiment the case 12 is made of a composite material (e.g., Ultem and glass or Nylon-12 with glass).

Figure 3:
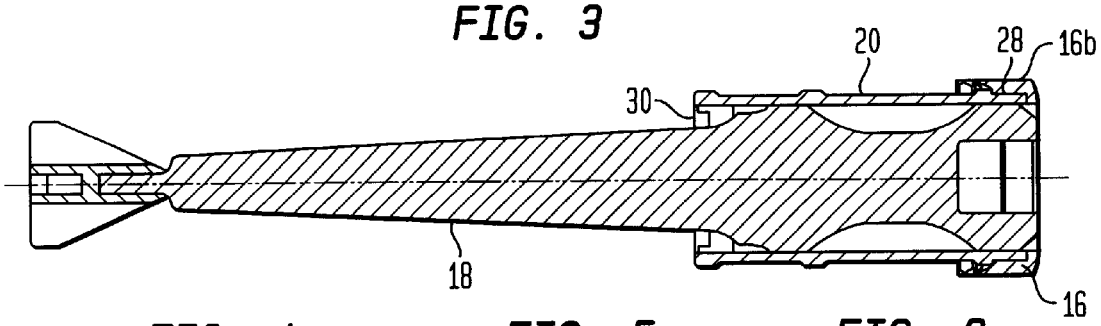
FIG. 3 is a cross sectional view of some of the interior components of FIG. 3, drawn to an enlarged scale.
Figure 4:
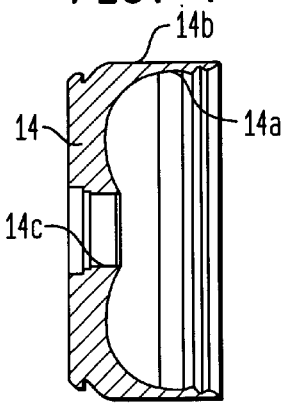
FIG. 4 is a cross-sectional view, drawn to an enlarged scale, of the aft seal of FIGS. 1 and 2.
Figure 5:
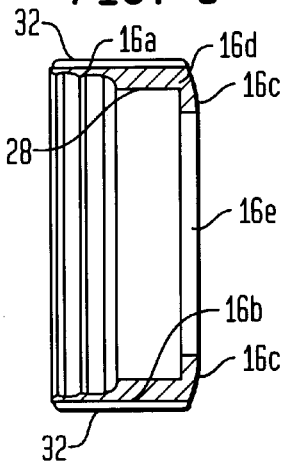
FIG. 5 is a cross-sectional view of an alternative embodiment of the forward seal of FIGS. 1 to 3.
Figure 6:
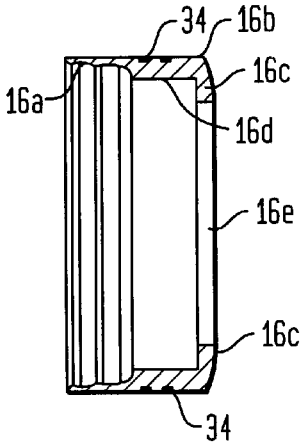
FIG. 6 is a cross-sectional view of yet another embodiment of the forward seal of FIGS. 1 to 3.

Forward seal 16, which is also shown in FIG. 3, and in different embodiments in FIGS. 5 and 6, and aft seal 14, which is also shown in FIG. 4, are required to perform multiple functions. More specifically, in the application discussed above, the seals 14 and 16 must provide a gas seal at the front and rear end of the swing chamber gun up to 90 Kpsi. The seals 14 and 16 must also support the cartridge case 12 and must remain attached to the cartridge case 12 so as to allow for chambering and de-chambering before firing and after firing, respectively. The seals 14 and 16 must also expand to meet with the gun chamber and dilate with the gun chamber to maintain sealing and then return to the original shape thereof so as to enable extraction thereof from the swing chamber gun. In addition, seals 14 and 16 must allow cartridge case 10 to be dislocated and thus the seals 14 and 16 may move backward and forward during the large pressure ballistic event and then relocate after the pressure dissipates to maintain a gas seal. This is necessary so that the seals 14 and 16 can move into position so as to seal the rear and forward ends of the seal chamber. The seals 14 and 16 and the cartridge case 12 must thereafter snap back together and return to the original position thereof so as to allow the swing gun chamber to move.

Figure 7:
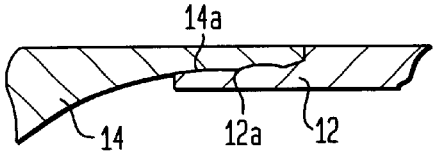
FIGS. 7 and 8 are each a cross-sectional view of a detail of the aft seal and case, showing the rest state of these components and a state of relative displacement or dislocation there between, respectively.
Figure 8:
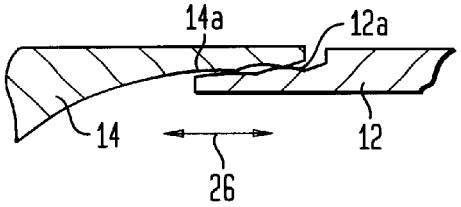

Considering the latter point in more detail and referring to FIGS. 7 and 8, aft seal 14 and case 12, as illustrated, include matching surfaces 14*a* and 12*a* having cooperating, generally V-shaped grooves therein that permit the dislocation just described. The original or rest position of these components is shown in FIG. 7 and the dislocated position in FIG. 8, with the two-end arrow 26 in FIG. 8 indicating the relative dislocation movement. Similar matching surfaces (not shown) are provided at the forward end of casing 12 and on forward seal 16. When pressurized, the seals 14 and 16 dislocate from the cartridge case 12, as shown for seal 14 in FIG. 8. The construction of the matching surfaces 12*a* and 14*a* is such that tips or distal ends of the matching V patterns thereof do not pass each other, i.e., do not separate, and thus, when the pressure is relieved, the seals 14 and 16 snap back together with the respective ends of case 12 to assume a position corresponding to that shown in FIG. 7. It is noted that after firing, the swing chamber moves from a horizontal position to a vertical position and the spent CTA cartridge 10 is ejected as a whole from the swing chamber.

The projectile sleeve 20 is best seen in FIG. 3 and, as shown in FIG. 2, is located within the interior of CTA cartridge 10. Sleeve 20 fits around and surrounds a forward portion of projectile 18, as illustrated, and provides support for projectile 18 during storage and handling. Sleeve 20 also provides projectile 18 with a smooth centering transition between the chamber and gun tube during ballistic firing. As shown in FIG. 3, sleeve 20 is supported by the front seal 16 by means of threads indicated at 28. Sleeve 20 can be considered to be an extension of the gun tube because sleeve 20 holds the projectile 18 and provides an obturator surface at shot start.

The projectile 18 is held to the sleeve 20 by means of an obturator 30 which is preferably made of plastic. Although this is not clearly shown in FIG. 3, obturator 30, which is attached to projectile 18, locks into a slot in sleeve 20. Obturator 30 provides a propellant gas seal between the projectile 18 and the gun tube during travel of the projectile 18 through the gun tube.

It is noted that should obturator 30 fail, propellant gas will blow by the obturator 30 and cause gas wash on the projectile 18, damage to the gun tube and loss of projectile velocity. An important feature of CTA cartridge 10 concerns the positioning of the projectile 18 inside the sleeve 20 in the cartridge case 12 and the forward seal 16 to prevent gas blow-by before the projectile 18/obturator 30 gets into the gun tube. It will be appreciated that the forward seal 16, sleeve 20, projectile 18 and obturator 30 make up the forward assembly of the CTA cartridge 10.

Projectile 18 includes a fin 32 as is conventional. It will be understood that projectile 18 can take other shapes and forms as can the propellant (not shown) used.

Referring again to FIGS. 3, 4, 5 and 6, as illustrated, seals 14 and 16 are each of a generally cup-shaped configuration, and include V-patterned respective projecting portions 14*a* and 16*a* which respectively engage corresponding portions of the opposite ends of case 12, as described above for aft seal 14 in connection with FIGS. 7 and 8. The respective outer circumferential surfaces 14*a* and 16*b* of seals 14 and 16 seal with the gun chamber while the forward surface 16*c* of forward seal 16 seal with the gun tube shoulder. Forward seal 16 also includes an internal portion 16*a* that includes threading 28 referred to above and used in supporting projectile 18. The said baseline seals 14 and 16 are steel, providing a steel seal with the steel gun chamber.

In an alternative embodiment shown for seal 16 only in FIG. 5 but applicable to both seals, a thin (e.g., 0.2 mm thick) plastic or rubber layer 32 is adhered to the exterior surface 16*b*. This embodiment functions the same as first, baseline embodiment described above except that with a layer corresponding to layer 32 the seals 14 and 16 provides a plastic or rubber seal with the steel gun chamber.

Figure 9:
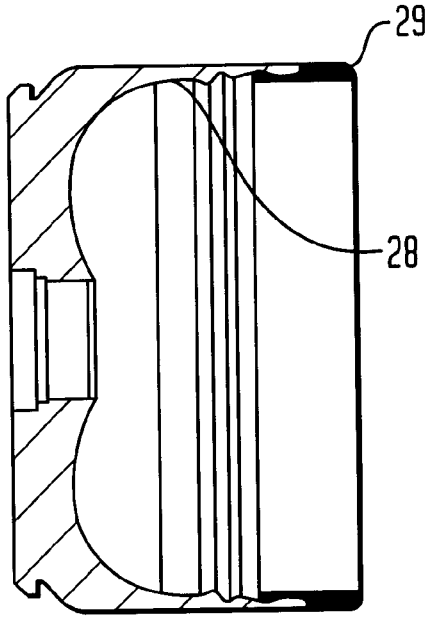
FIG. 9 is a cross-sectional view, drawn to an enlarged scale, of the aft seal of FIG. 4, but with the steel projecting portion slightly extended and a rubber lip added to the steel projecting portion 4*a* thereof, the rubber being used as a primary seal.
Figure 10:
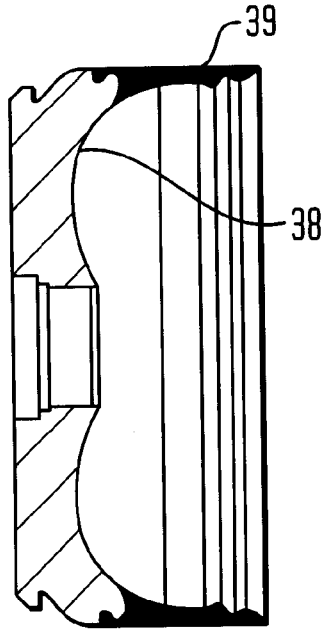
FIG. 10 is a cross-sectional view, drawn to an enlarged scale, of the aft seal of FIG. 4, but with the steel projecting portion 4*a* thereof entirely replaced by rubber.

A further similar embodiment is shown in FIG. 6, wherein one or more rubber or plastic rings 34 are used. The use of such a ring 34 for seals 14 and 16 provides a rubber or plastic seal in addition to the primary metal-to-metal seal with the gun chamber. Still other embodiments are shown by FIGS. 9 and 10 wherein rubber tips have been added on the tips 14 and 16. This rubber provides a low pressure rubber seal to the steel gun tube which seal is known as a primary seal. In addition, the steel portion of the seal provides a secondary seal to the steel gun tube.

In all embodiments thereof, aft end seal 14 includes a rear aperture 14*c* which enables a primer 22 to be threaded in and held for later functioning, and forward end seal 16 includes a front opening 16*e* for the forward or front end of projectile 18.

The cartridge 10 may include a cannon proof slug, KE slug, and Multi-purpose (MP) slug, (not shown). Testing of the cannon proof and KE slug has demonstrated the ability of a 105 mm kinetic energy (KE) projectile with a puller or pusher type sabot. Multi-purpose type cargo cartridges with a stick propellant and warhead projectiles have also been successfully tested as demonstrated with the MP slug.

The baseline CTA components have been ballistically tested from −25° F. to 145° F. and to 98 Kpsi. The seals 14 and 16 and the sleeve 20 are preferably made of a material (e.g., 4340 (300M)) that allows these components to meet a tensile strength minimum yield of 220 Kpsi with a minimum elongation of 10%. These properties ensure the structural survivability of the seal provided, as well as the ability of the assembly to return to shape and thereafter be extracted from the swing chamber in the ballistic event.

Although the invention has been described above in relation to preferred embodiments thereof, it will be understood by those skilled in the art that variations and modifications can be effected in these preferred embodiments without departing from the scope and spirit of the invention.

What is claimed is:

1. A case telescoped ammunition cartridge comprising:

a cartridge case having a forward end and an aft end;

a projectile disposed within said casing and having a forward end and an aft end;

a sleeve surrounding at least a portion of the forward end of the projectile and having a forward end and an aft end;

an obturator disposed between the aft end of the sleeve and a part of said portion of the forward end of the projectile;

an aft end seal affixed to said case at the aft end of case so as to be relatively movable with respect thereto during firing of the cartridge and including an external lateral surface adapted to engage an inner wall surface of a gun chamber;

a forward end seal affixed to said case at the forward end of the case so as to be relatively movable with respect thereto during firing of the cartridge and including an external lateral surface adapted to engage the inner wall surface of the gun chamber and an external end surface adapted to abut a forward end surface of the gun chamber, said forward seal being secured to the forward end of said sleeve so as to support said sleeve within said case, wherein said forward and aft end seals are cup-shaped and include a base portion and a substantially cylindrical wall portion projecting outwardly from said base portion, wherein said wall portions of said end seals include engagement surfaces for engaging corresponding engagement surfaces of said cartridge case, wherein said engagement surfaces of said end seals and said cartridge case include V-shaped grooves therein for enabling longitudinal dislocation between the end seals and the corresponding ends of the cartridge case while preventing full disengagement of said engagement surfaces and corresponding separation of said end seals from said case, wherein said engagement surfaces of said end seals are located on interior parts of the projecting wall portions thereof, and wherein the projecting wall portion of said forward end seal further includes an interior surface secured to said sleeve and located forwardly of the engagement surface of the forward end seal.

2. A cartridge according to claim 1 wherein said interior surface includes screw threading and a corresponding portion of said sleeve secured to said forward end seal includes complementary screw threading.

* * * * *